US009992592B1

(12) United States Patent
Alam et al.

(10) Patent No.: US 9,992,592 B1
(45) Date of Patent: Jun. 5, 2018

(54) VACUUM TESTING OF AUDIO DEVICES

(71) Applicant: Amazon Technologies, Inc., Reno, NV (US)

(72) Inventors: Mohammed Aftab Alam, San Jose, CA (US); Ramez Nachman, San Francisco, CA (US); Vikram Srinivas, San Jose, CA (US); Donald Joseph Ashley, San Francisco, CA (US); Ali-Reza Bahmandar, San Jose, CA (US)

(73) Assignee: AMAZON TECHNOLOGIES, INC., Reno, NV (US)

( * ) Notice: Subject to any disclaimer, the term of this patent is extended or adjusted under 35 U.S.C. 154(b) by 841 days.

(21) Appl. No.: 14/146,990

(22) Filed: Jan. 3, 2014

(51) Int. Cl.
*H04R 29/00* (2006.01)

(52) U.S. Cl.
CPC ..... *H04R 29/00* (2013.01)

(58) Field of Classification Search
CPC .... H04R 29/00; H04R 29/001; H04R 29/004; H04R 3/04; G06F 3/165
USPC ..... 381/58, 59, 60, 64, 71.1, 71.7, 191; 73/570, 571, 579, 602
See application file for complete search history.

(56) References Cited

U.S. PATENT DOCUMENTS 2,530,383 A * 11/1950 Estes ..... H04R 29/00 381/58
6,036,918 A * 3/2000 Kowanko ..... A01N 37/16 422/33
7,908,033 B2 * 3/2011 Gross ..... G01H 1/12 700/280
2005/0254673 A1 * 11/2005 Hsieh ..... H04R 19/016 381/175
2011/0243368 A1 * 10/2011 Doh ..... H04R 9/025 381/398
2014/0328489 A1 * 11/2014 Ziegler ..... H04R 29/004 381/58

OTHER PUBLICATIONS

Harry F. Olson, Microphone Thermal Agitation Noise, RCA LaboratoriesP, rinceton,N ew Jersey0 8540, Oct. 1971, The Journal of the Acoustical Society of America, pp. 425-432.*
Stephen C. Thompson,b) Janice L. LoPresti, Eugene M. Ring, Henry G. Nepomuceno, John J. Beard, William J. Ballad, and Elmer V. Carlson; Noise in miniature microphones; J. Acoust. Soc. Am. 111 (2), Feb. 2002, pp. 861-866.*
C. S. Premachandran, Ser Choong Chong, Saxon Liw, and Ranganathan Nagarajan; Fabrication and Testing of a Wafer-Level Vacuum Package for MEMS Device, IEEE Transactions on Advanced Packaging, vol. 32, No. 2, May 2009, pp. 486-490.*
(Continued)

*Primary Examiner* — Vivian Chin
*Assistant Examiner* — Friedrich W Fahnert
(74) *Attorney, Agent, or Firm* — K&L Gates LLP

(57) ABSTRACT

A method of assessing noise involves evacuating air from a vacuum chamber to a pressure less than about 1 Torr and stimulating a device positioned in the chamber by shaking it or by operating a component of the device. Measuring vibrations in a low pressure environment decreases or eliminates propagation of sound waves, thereby enabling isolation and identification of vibrations caused by mechanical noise. These measurements may be useful for more precise acoustic characterization of audio devices containing multiple components.

21 Claims, 8 Drawing Sheets

(56) References Cited

OTHER PUBLICATIONS

Yaakov Kraftmakher, Further experiments with a loudspeaker, Department of Physics, Bar-Ilan University, Ramat-Gan 52900, Israel, Published Mar. 30, 2010, pp. 579-589.*
Wolfgang Klippel, Modeling the Large Signal Behavior of Micro-Speakers, Presented at the 133rd Convention Oct. 26-29, 2012 San Francisco, CA, USA, Audio Engineering Society, pp. 1-10.*

* cited by examiner

VACUUM TESTING OF AUDIO DEVICES

BACKGROUND

In conventional acoustic testing, an object is placed in an acoustic anechoic chamber in which one or more microphones positioned around the object detect noise generated by the object by using the microphone's diaphragm to sense the object's vibrations as conveyed through ambient air. Sound-absorbing tiles placed upon walls of the anechoic chamber prevent sound from being reflected in order to better isolate noise generated by the object from reflected noise.

Conventional anechoic chambers may enable accurate testing of isolated components, such as a microphone or an audio speaker. However, when these components are integrated into a larger system comprising multiple components, the behavior of these individual components may be modified, thereby reducing the accuracy of the testing that may be performed using these chambers.

BRIEF DESCRIPTION OF DRAWINGS

FIGS. 3A-3B provide examples of a signal from a vibration detector, in which FIG. 3A illustrates resonances that include acoustic coupling resonance and FIG. 3B illustrates resonances as identified in a method disclosed herein.

DETAILED DESCRIPTION

Figure 1:
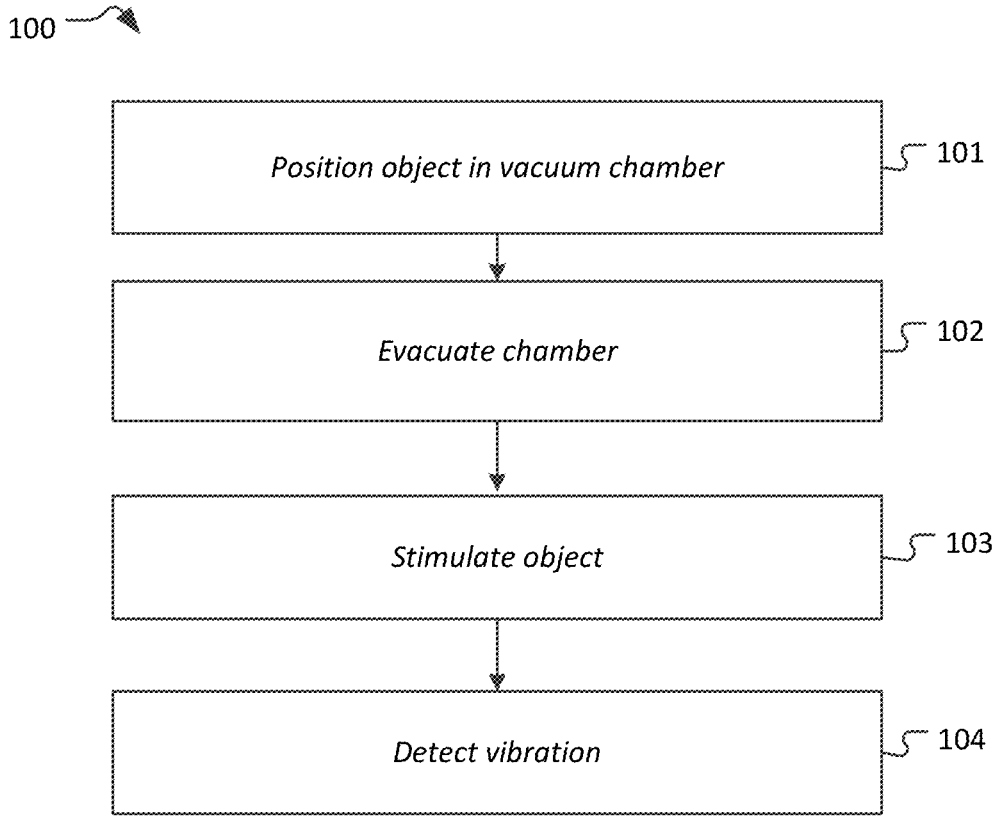
FIG. 1 is a high-level flowchart of a method provided by the invention.

In the following description, reference is made to the accompanying drawings which illustrate certain embodiments of the invention. It is understood that other embodiments may be utilized and mechanical, compositional, structural, and/or electrical operational changes may be made without departing from the spirit and scope of the present disclosure. The following detailed description is therefore not to be taken in a limiting sense, and the scope of the embodiments of the present invention is defined only by the claims of the issued patent.

A vacuum test method is provided herein for detecting noise and other vibrations. The vacuum test method evacuates air from space within a vacuum chamber. An object in the air-evacuated space vibrates in response to a stimulus, and these vibrations are detected to identify unwanted vibrations that are mechanically transmitted through the object and to the sensor. Also provided is equipment for identifying vibrations and noise generated by the object.

Devices containing audio speakers are designed to generate audible sound, such as music or voice audio, so when the devices are activated to produce sound, it is expected that a microphone in the device would detect vibrations caused by sound waves produced by the audio speakers. However, in addition to producing the desired and expected vibrations (e.g., sound waves from the music being played on the speakers), the device may also produce unwanted noise. Noise is the result of unwanted pressure variations (e.g., oscillations) in an elastic medium such as air, and these pressure variations may be generated by, e.g., a vibrating surface, adjacent fluid flow (as in a pipe or duct), and/or a desired pressure wave (a desired sound) interacting with surfaces and/or other sound waves in the elastic medium. Air or other elastic fluid in a conventional acoustic anechoic chamber transmits noise as well as any desired sound from the object to one or more microphones, whose diaphragms vibrate in response to the sound waves generated by the object.

In accordance with embodiments of the present invention, vacuum test methods may be used to isolate and identify the resonance behavior of different components of a system. For example, the speaker in an audio device will resonate at certain frequencies in the audible spectrum. It may be desirable to reduce these resonances to improve the sound quality of the device. However, in a system with multiple subsystems, identifying the cause of the resonance may be difficult. In some cases, the origin of the resonance may be mechanical, such as if a mechanical structure in one of the subcomponents of the system vibrates, or acoustic, such as when trapped air reflects off of other structures and vibrates, so it can be difficult to determine whether any detected resonance frequencies are mechanical or acoustic in origin. If resonance testing is performed inside of a vacuum chamber, the resonant frequencies of acoustic origin will decrease or disappear because the low-pressure environment inhibits the propagation of sound waves. Therefore, the detected resonance frequencies at low pressure indicates that the cause is mechanical, not acoustic. Similarly, resonance frequencies that are detected during testing at higher pressure (e.g., atmospheric pressure), but not detected at lower pressures (e.g., in the evacuated vacuum chamber), may be assumed to have acoustic origins.

In accordance with other embodiments of the present invention, vacuum test methods may be used to measure the vibration sensitivity of microphones. A microphone is an acoustic-to-electric sensor that converts sound into electrical signals. The microphone has a diaphragm that reciprocates in response to sound waves striking the diaphragm, and converts this motion to an electrical signal. When a microphone is operated in a vibrating environment, these vibrations may also cause reciprocation of the diaphragm, thereby producing unwanted noise in the electrical signal in addition to the desired sound waves that the microphone is intended to receive. The sensitivity of a microphone which is incorporated into a larger system can be determined by performing acoustic tests in a low pressure vacuum chamber, as will be described in greater detail below. In these tests, an actuator is used to apply an oscillating mechanical force to the entire system containing the microphone at various frequency ranges of interest. Any sound that would be generated by the actuator and audible at atmospheric pressure would not be detected by the microphone in the low pressure environment of the vacuum chamber because the sound waves could not reach the microphone in the absence of air. Therefore, the electrical signals generated by vibration of the microphone's diaphragm are produced only by vibration of the system. Accordingly, the response of the microphone recorded in the low pressure environment while being agitated by the actuator directly provides the vibration sensitivity of the microphone.

In accordance with embodiments of the present invention, a method of detecting noise as disclosed herein and as summarized in FIG. 1 is provided. In step 101, an object is positioned in a vacuum chamber. In step 102, a sufficient amount of sound-conveying fluid from within the vacuum testing chamber is removed to reduce or remove acoustically coupled noise from a signal representative of a sound generated by the object. Such acoustically coupled noise can include noise caused by, e.g., reflection of acoustic waves in any of various locations in or around the object, by fluid compression in confined spaces or expansion in enlarged spaces, and/or other noise generated by pressure waves interacting with surfaces in air. This method further includes stimulating the object to produce vibrations in step 103 and detecting unexpected vibration in a signal obtained as a result of the applied vibration in step 104. The object can be stimulated by, e.g., vibrating the object to cause unwanted vibrations. The object can be stimulated instead or additionally by operating the object to run one or more electronic components of the object. Unwanted vibrations are detected by, e.g., a vibration sensor that senses mechanical vibration of the object in response to the stimulus.

These steps are better understood in conjunction with two specific examples, one in which the object is stimulated by an external mechanical force to detect unwanted vibrations, and one in which the object is stimulated by operating the object, e.g., electrically so that one or more of the object's components generate unwanted vibrations during operation.

Figure 2:
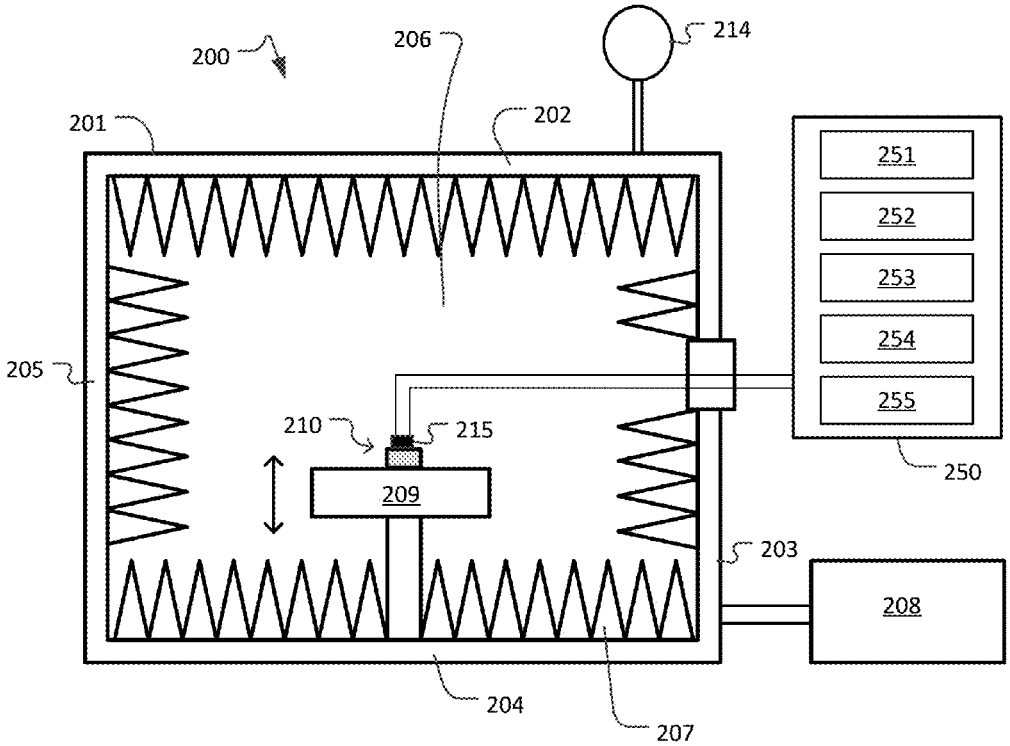
FIG. 2 depicts a vacuum testing chamber having a first object within it.

FIG. 2 depicts a vacuum testing chamber 200 having an object 210 within it, for example, a microphone. Vacuum testing chamber 200 has a housing 201 comprised of one or more walls 202, 203, 204, 205 defining an enclosed space 206, which walls may be bare or which may be covered partially or completely with acoustic tiles 207 that absorb any sound transmitted in the rarified atmosphere of the enclosed space. The illustrated vacuum testing chamber also has a vacuum pump 208 in fluid communication with the enclosed space. The vacuum pump removes air from the enclosed space to a pressure as shown by gauge 214, and the absence of air makes noise detection very difficult if one were to use microphones placed a sufficient distance from an object that air conveys vibrations generated by the object 210.

Object 210 is stimulated by, e.g., applying electricity to it, applying a magnetic force to it, and/or applying a mechanical force to it by vibrating it, for instance. Vacuum testing chamber 200 depicted in FIG. 2 has an optional support 209 that holds the object 210 in the chamber's space. The support may be movable so that the support vibrates the object through a range of frequencies and/or at different amplitudes. The support may be movable vertically, for instance, using, e.g., hydraulic pressure or a mechanical actuator to subject the object to various vibrations. Alternatively, the support 209 may be stationary and not configured to apply vibration into the object, especially where object 210 is stimulated using electricity to activate a component within object 210.

One or more vibration sensors 215 form part of or are placed on or in the vicinity of the object 210. A vibration sensor senses vibration from the object that is generated in response to the vibration applied to the object.

The vibration sensor senses the object's mechanical vibration in the absence of air within the chamber. Noise generated by the object may be detected by reviewing the signal generated by the vibration sensor. If the object does not generate mechanical noise, the sensor detects essentially only what vibration is caused by an applied stimulus such as a shaker table on which the object is placed.

As mentioned, object 210 may be an acoustic sensor, such as a microphone that converts sound into an electrical signal. A microphone may be vibrated using, e.g., a shaker table 209, and the diaphragm within the microphone moves due to the vibration applied by the table if the microphone has nothing that generates mechanical noise. The output of the microphone will therefore generally follow the frequency and amplitude of the applied vibration if the microphone does not generate noise.

The vibration applied to the microphone by the stimulus may cause portions of the microphone such as the microphone screen or portion of the microphone's housing to resonate, thereby generating noise. Mechanical vibration generated within the microphone alters the microphone's output signal. The additional unwanted vibration changes diaphragm movement that would normally occur due to the mechanical stimulus moving the microphone, and consequently a signal obtained from the microphone deviates from the expected signal and therefore contains noise. The microphone's signal as detected by the microphone's diaphragm consequently has a frequency and/or amplitude that differs from the frequency and/or amplitude of the applied vibration when a portion of the microphone generates noise.

The system may further include a computing device 250 for analyzing the signals received by the vibration sensor 215. The computing device 250 may also control the stimulation of the object 210 by, for example, transmitting control signals to the shaker table 209. The computing device 250 may comprise any type of computing device capable of determining, processing, and receiving inputs can be used in accordance with various embodiments discussed herein. The computing device 250 includes at least one processor 251 for executing instructions that can be stored in at least one memory device 252. As would be apparent to one of ordinary skill in the art, the memory device 252 can include one or more different types of memory, data storage or computer-readable storage media, such as, for example, a first data storage for program instructions for execution by the processor, a second data storage for data and/or a removable storage for transferring data to other devices. The computing device 250 may include a display 253 for displaying information and input elements 254 operable to receive inputs from a user (e.g., mouse, keyboard, touchpad, touchscreen, etc.). The computing device 250 may also include at least one communication interface 255 operable to communicate with one or more separate devices. The communication interface 255 may comprise, for example, a wired or wireless communication interface for communicating with the object 210 and receiving the detected vibration signals from the object 210. This communication of vibration data may occur in real-time as the tests are being performed, the vibration data may be stored in a storage device contained in the chamber 210 and transferred to the computing device 250 after testing is complete. The wireless protocol can be any appropriate protocol used to enable devices to communicate wirelessly, such as, e.g., Bluetooth, cellular, or IEEE 802.11.

Figure 3A:
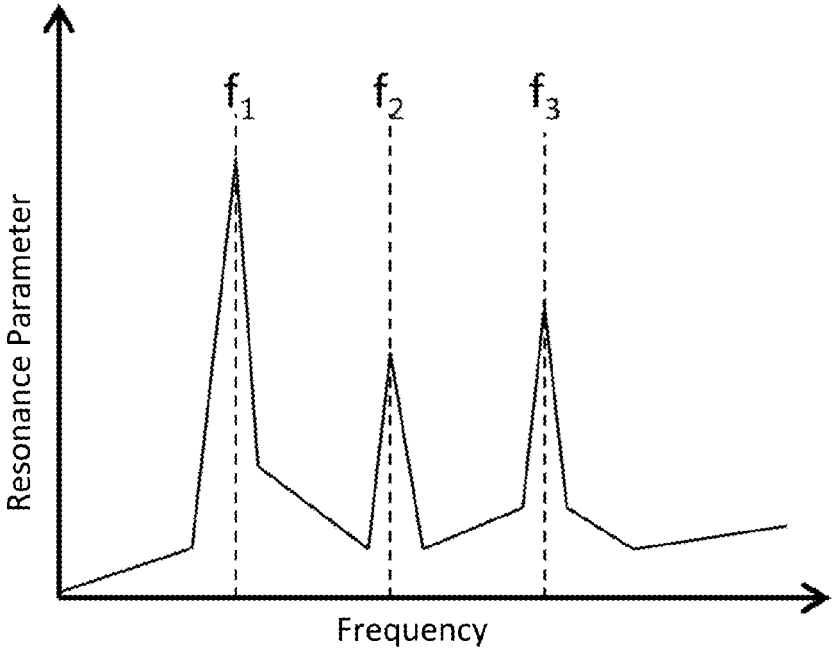
Figure 3B:
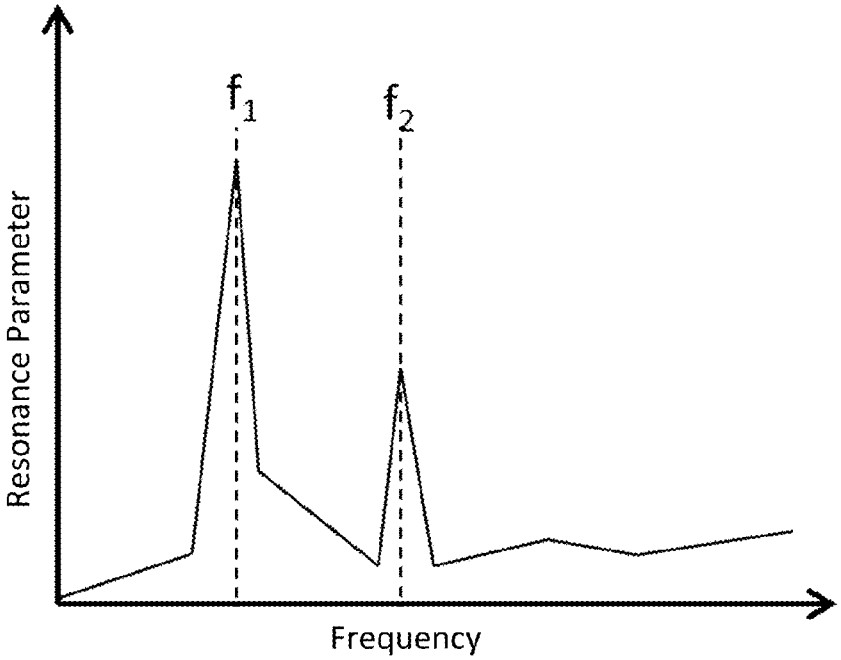

FIG. 3 illustrates data generated when a vibration sensor (e.g., a microphone) detects vibration in air under normal atmospheric pressure (FIG. 3A) and as described above (FIG. 3B), in which a vibration sensor detects vibration where a sufficient amount of air is evacuated from the vacuum chamber's space 206 to reduce or suppress an acoustical coupling signal and increase a signal-to-noise ratio of the signal. FIG. 3A depicts three resonance frequencies $f_1$, $f_2$, and $f_3$ in the scanned frequency range at which vibrations occur in atmospheric pressure. FIG. 3B depicts frequencies at which only mechanical vibration occurs. Vibration at frequency $f_3$ is reduced or suppressed because this vibration is due to acoustical coupling. The air is evacuated from the vacuum chamber's space sufficiently in the test shown in FIG. 3B to reduce or suppress vibration due to acoustical coupling. The resonances at frequencies $f_1$, $f_2$ are unwanted vibrations caused by vibrating an object 210 at different frequencies in the frequency range.

Figure 4:
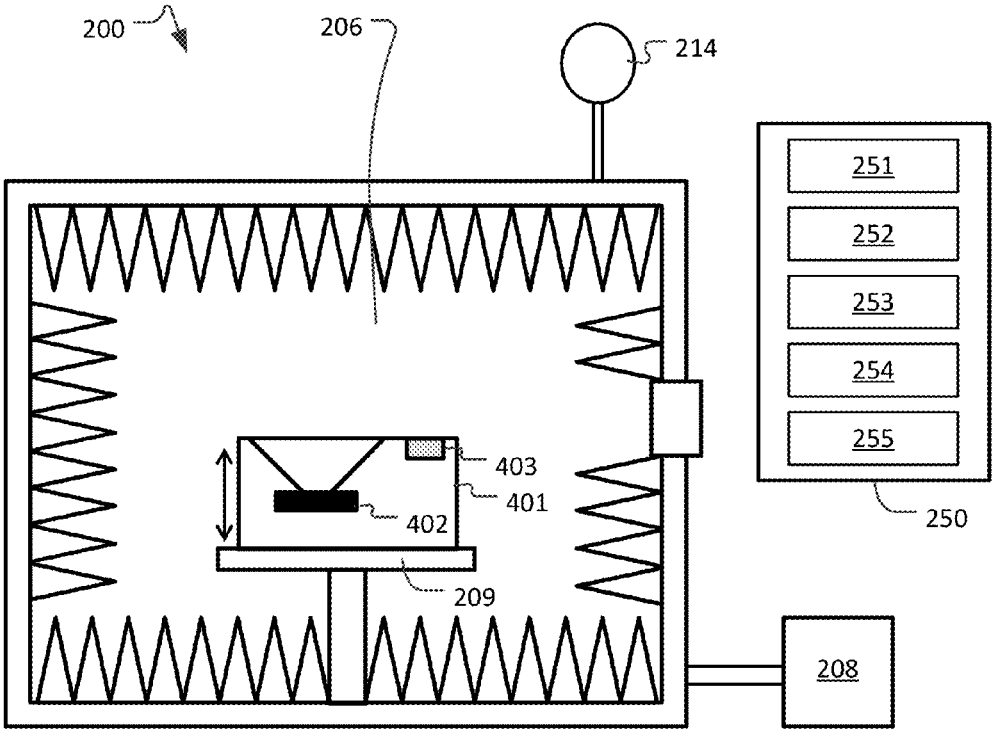
FIG. 4 depicts a vacuum testing chamber having a second object within it.

FIG. 4 illustrates another object 401, a multicomponent object in which a microphone may be one component. In this instance, the object has both a speaker and a microphone integrated into the object. Examples of object 401 include electronic devices such as audio speaker systems (e.g., wired or wireless speaker systems), speakerphones, smartphones, electronic book readers, tablet computers, notebook computers, personal data assistants, cellular phones, video gaming consoles or controllers, television set top boxes, and portable media players, among others, and each may have both a speaker 402 and a microphone 403 as part of the object in the chamber under vacuum. The object's integral microphone is consequently in a position to receive mechanical vibration generated by the speaker and/or other parts of the object. This sort of unwanted mechanical vibration that generates noise is conveyed through the object's housing and sensed by the microphone in the same manner as that discussed above for the microphone.

The components of an object may generate noise a number of ways. For instance, a portion of a speaker may resonate at a certain frequency and/or amplitude of stimulus. The stimulus may be external such as an externally-applied vibration as discussed above, and/or the stimulus may be, e.g., the speaker diaphragm vibrating to generate music or voice reproductions. The speaker may cause another portion of the object to vibrate, such as a nearby electronic card attached to the housing or motherboard. The speaker may also cause the object to vibrate upon the support table 209, which in this instance may be stationary and therefore not inducing vibration into the object. Likewise, other moving components within the object, such as, e.g., a fan within the object, will generate mechanical vibrations directly or by causing another portion of the object to resonate. The method as described above aids in identifying noise that has a mechanical origin.

In summary, as described in the preceding paragraphs, one method of assessing noise involves:

evacuating an amount of an elastic fluid from a space within a vacuum chamber, the vacuum chamber containing (a) an object and (b) a vibration sensor that produces a signal in response to vibration of the object, wherein the amount of elastic fluid evacuated from the space comprises a sufficient amount to reduce or suppress an acoustical coupling signal and increase a signal-to-noise ratio of the signal;

stimulating the object to vibrate the object; and detecting unexpected vibration by the object to obtain first data representing unwanted mechanical vibration within the object.

Each of these steps is discussed in greater detail below.

Evacuating Sufficient Amount of Elastic Fluid to Reduce or Suppress Acoustical Coupling Signal As discussed above, a sufficient amount of elastic fluid is evacuated from the space in the vacuum testing chamber that an acoustic coupling signal is reduced or suppressed. The vibration sensor therefore detects predominantly or essentially only the object's mechanical vibration in the method described above. In one instance in which air is the elastic fluid, the amount evacuated provides a pressure of no more than about 10 Torr in the space within the vacuum testing chamber. The pressure may of course be lower, such as no more than about 7 Torr, or no more than about 1 Torr. In some instances, pressure is no more than about 0.5 Torr, 0.1 Torr, or 0.01 Torr.

Stimulating the Object to Vibrate the Object

The object may be stimulated using various stimuli. In one instance, the object is vibrated by applying an external mechanical force using an actuator. The actuator may comprise any device for applying a mechanical force to the object, such as, for example, a shaker table or other conventional vibration test equipment.

The object may be stimulated using electricity by driving, e.g., an object's component such as a fan and/or speaker and measuring mechanical vibration generated by the moving fan and/or moving speaker. The component may have a voltage applied but draw little or no current (a capacitor, for instance), or the component may have a voltage applied and require a current to operate.

Figure 5:
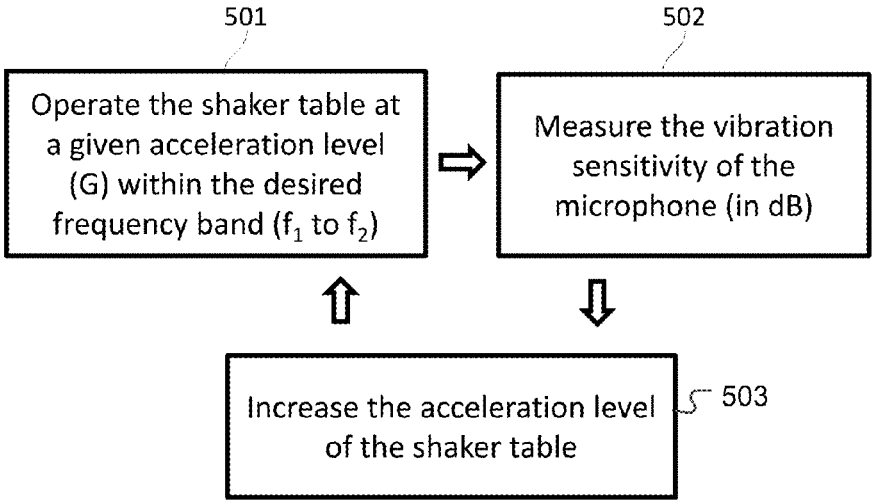
FIG. 5 is a block diagram of a method provided herein.
Figure 6:
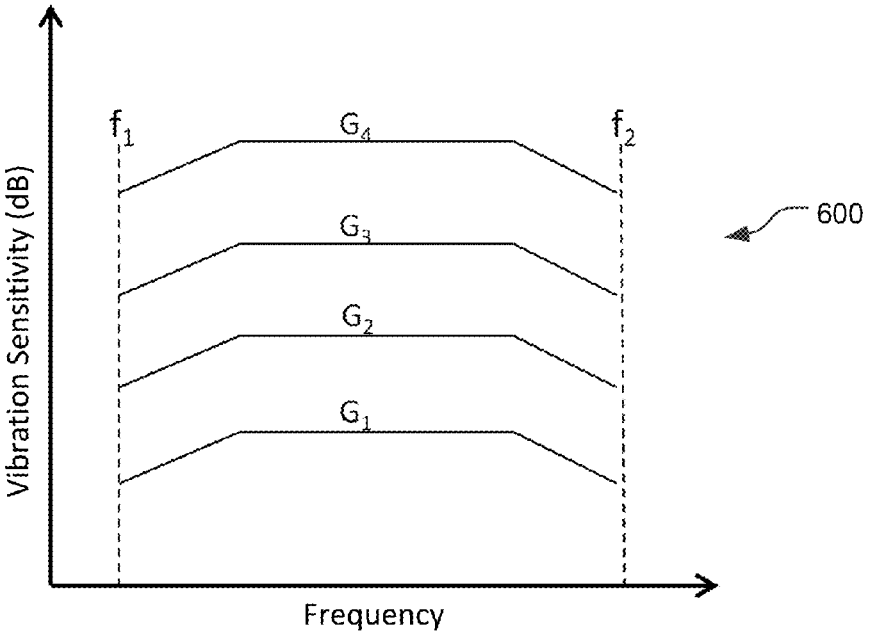
FIG. 6 is a table illustrating sensed vibrations in which amplitude is held at constant values while varying the frequency.

The object may be stimulated in periodic fashion in one method of the invention. For instance, the object may be mechanically vibrated starting at one frequency and continuing to a second frequency as illustrated in the method depicted in FIG. 5. The amplitude at which the object is mechanically vibrated may be kept constant over a frequency range. The amplitude may also be ramped up to frequency $f_1$ and down from $f_2$ as depicted in FIGS. 5-6. Ramping the amplitude helps to identify transient vibrations not otherwise identified at constant amplitude. In step 501, the shaker table 209 is operated at a given acceleration level (G) within the desired frequency band ($f_1$ to $f_2$). In step 502, the vibration sensitivity of the microphone in dB is measured. In step 503, the acceleration level of the shaker table 209 is increased. The measured vibration sensitivity at different frequencies is shown in FIG. 6.

The step of stimulating the object to vibrate it may be performed in a variety of ways. For example, an oscillating mechanical force may be applied to the object to vibrate the object at different frequencies and/or amplitudes. This mechanical force may be applied by a component internal or external to the object. The vibration sensor may be provided in a variety of locations, such as, for example, as an integral part of the object. In some embodiments, the object comprises an electronic device containing a microphone and the vibration sensor comprises a diaphragm of the microphone.

The object may be moved by securing the object to a shaker table and moving the table, or by securing a vibration device to the object and activating the vibration device, for instance. The frequency at which the object is moved is typically selected based on expected sources of object vibration. Frequency may vary between 15 and 25,000 Hz and amplitude may vary between various values as may be encountered during the object's use to assess what unwanted sounds are generated within an extended range of hearing.

The periodic vibration may instead or additionally be induced by operating at least one component of the object. For example, a speaker may be driven from low frequency to high frequency in the speaker's frequency range as described above and vibration measured in the object in which the speaker is a component.

Figure 7:
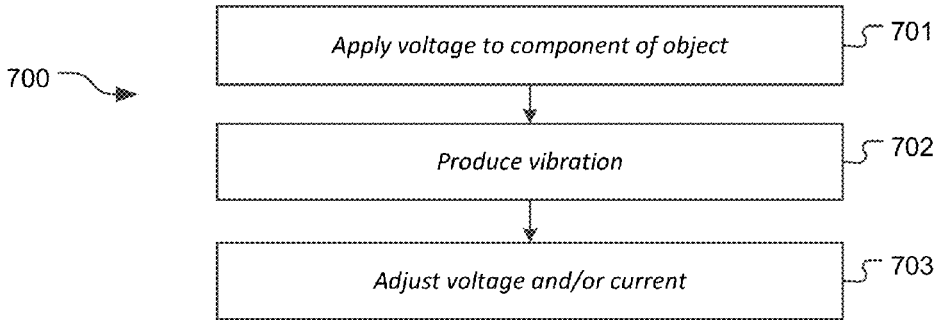
FIG. 7 is a high-level flowchart depicting a particular method of stimulating an object.

In another instance, a component such as a fan may be driven from one speed to a different speed by increasing voltage and/or current rather than increasing frequency of vibration. Voltage and/or current may be varied continually from a low to a high value, for example, or voltage and/or current may be increased step-wise over a range. FIG. 7 is a flowchart illustrating a method 700 by which an object may be stimulated. In step 701, a varying voltage and/or current is applied to a component of the object. This produces expected vibration and said unwanted mechanical vibration in step 702. In step 703, the voltage and/or current may be varied periodically. In some embodiments, the component whose voltage and/or current is varied comprises an audio speaker.

Alternatively or additionally, a component may be placed in its usual use under normal operating conditions, and vibration measured. For instance, a speaker may be driven with music signals and vibration measured as the speaker attempts to reproduce the music. In computing device objects having a cooling fan, the cooling fan may operate at low speed and suddenly move to higher speed as a result of increased simulated or actual load within the computing device during testing.

The object may, for instance, comprise a microphone that is used to detect the unexpected vibrations. As discussed previously, a microphone typically has a diaphragm that vibrates in response to sound received by the microphone, and the diaphragm may also vibrate in response to unwanted mechanical vibrations in the microphone or object. Consequently, a method as described above may include detecting unexpected vibrations in the vacuum ambient by vibrating a diaphragm such as a diaphragm of a microphone.

The object may have multiple electrical components integrated into the object, and these components may each be a source of unwanted mechanical vibration. As noted previously, one such electrical component is a speaker. Music, voice, and other sounds played through a speaker may cause portions of the speaker (other than the speaker cone, ribbon, or panel used to reproduce sounds) to vibrate in unwanted ways as vibrations are transmitted throughout the object. Alternatively or additionally, other components forming part of the object may produce unwanted vibrations in response to the speaker reproducing sound. Consequently, the act of stimulating an object in any method above may involve playing a sound through an object's speaker at different frequencies and/or amplitudes.

The object may also have the vibration sensor as a component, and this vibration sensor may be a microphone. Therefore, in accordance with embodiments of the present invention, an object may contain both a source of the unwanted mechanical vibration and the vibration sensor. The vibration sensor may comprise a microphone, for instance, and the object's component that is the source of unwanted mechanical vibration may comprise, e.g., a speaker, a fan, a hard-disk drive, or any combination of these.

An object may be, e.g., a microphone, cell-phone, desktop computer, laptop computer, tablet computer, audio conferencing equipment such as a speaker-phone, gaming system, or an electronic reader. Each of these may have components that can resonate, such as a microphone or speaker grill, speaker, housing, fan, hard-disk drive, card or board within the component, wiring, etc.

Detecting Unexpected Vibration

Vibration may be detected using many different methods. Vibration may be detected optically, for instance, using an optical vibrometer. Alternatively, vibration may be sensed mechanically or electrically by vibrating a part within a vibration sensor. The vibration sensor may be a microphone that is an integral part of an object. The vibration sensor may also or instead be an accelerometer, cantilever-piezoelectric vibration sensor, capacitor-type or inductor-type vibration sensor. An optical sensor for detecting vibration does not need to be attached to the object. Other sensors such as those discussed above may be in contact with or an integral part of the object.

Variation of Method Above Involving Speaker and Microphone or Other Vibration Sensor In one test procedure to identify vibration in an object containing both a speaker and microphone, the speaker is driven through a sound range in which sound frequency and/or amplitude are varied, and the object's microphone senses vibration caused by the speaker. The speaker transmits normal sound vibration into the speaker's housing throughout the tested frequency range, and therefore the microphone detects either no vibration because the cone of the speaker is perfectly isolated or desired vibration from, e.g., music despite no air being present in the chamber's space. However, other unwanted vibrations induced by speaker movement distort the signal generated by the microphone as the microphone detects the music's vibrations so that the signal from the microphone deviates from an expected output. Noise is visible in a trace of the microphone's output signal.

Variation of Method Above where Stimulus Operates in Frequency Range and Different Amplitudes A method of identifying noise as discussed herein may involve subjecting the object to a first amplitude of vibration over a first frequency range, and subsequently subjecting the object to a second amplitude of vibration over the first frequency range. For instance, FIG. 6 is a table illustrating sensed vibrations in which amplitude is held at a first constant value $G_1$ and the frequency varies between values $f_1$ and $f_2$ in a first range. Subsequently, amplitude is maintained at a second constant value $G_2$ while frequency is varied as before in the first range. This process may be repeated for other values of amplitude $G_3$ and $G_4$ for instance. The amplitude may also be ramped up to frequency $f_1$ and down from $f_2$ as depicted in FIG. 6. Ramping the amplitude helps to identify transient vibrations not otherwise identified at constant amplitude. The values of amplitude may be determined based on anticipated values that the object will encounter in daily life, or the values of amplitude may be separated from one another by an empirically-chosen amount, for instance.

Figure 8:
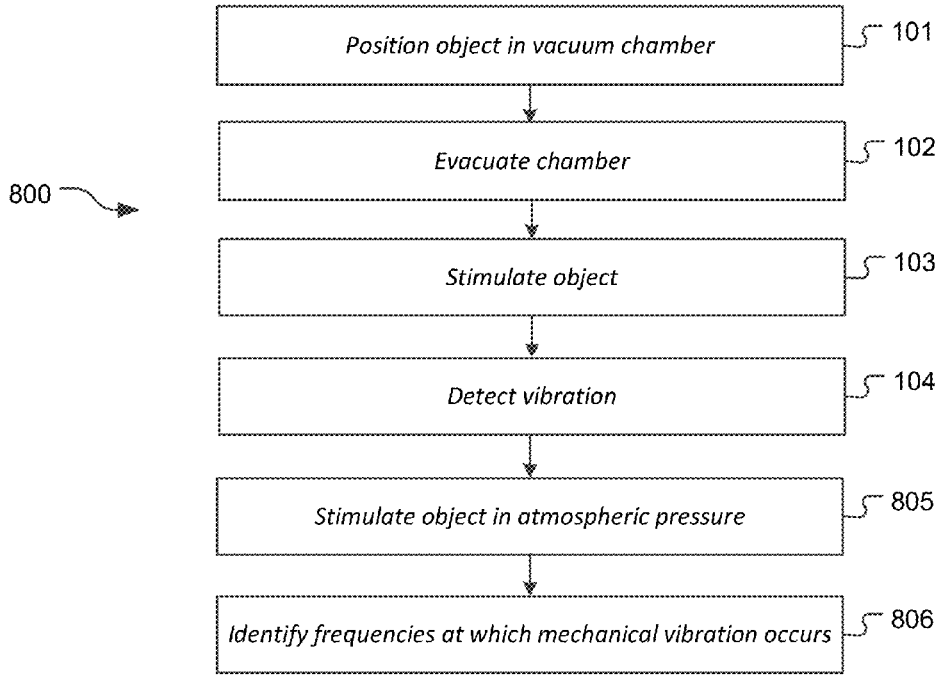
FIG. 8 is a high-level flowchart of a method that involves obtaining vibration data in vacuum and in ambient air and comparing the two.

FIG. 8 is a flowchart depicting one such method 800. FIG. 8 includes steps 101-104 as discussed previously with respect to FIG. 1, and also includes step 805 of stimulating the object in atmospheric pressure (e.g., ambient air) to obtain data representing both (a) the unwanted mechanical vibration of components within the object and (b) vibration due to acoustical coupling. In step 806, this data representative of mechanical vibration and vibration due to acoustical coupling is compared to the vibrations obtained from steps 101-104 to identify frequencies at which the mechanical vibration and not vibration due to acoustical coupling occurs. The frequencies at which mechanical vibration occurs help in identifying effectiveness of control measures when addressing sources of vibration as discussed below.

Figure 9:
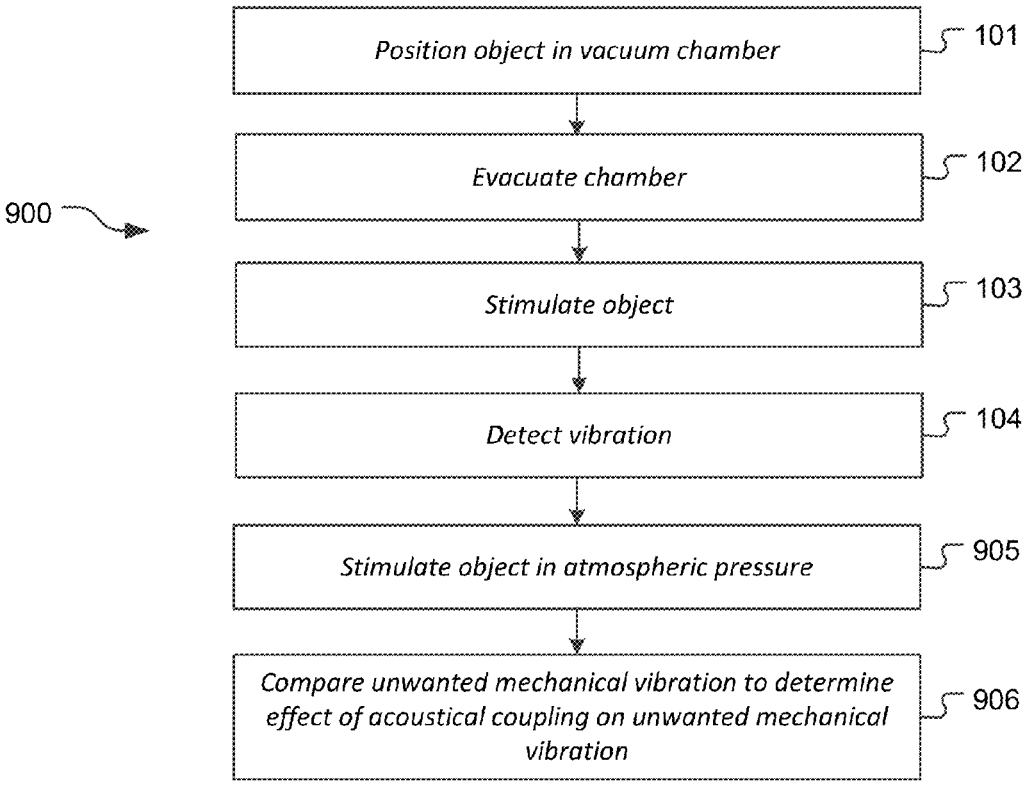
FIG. 9 is a high-level flowchart of a second method that involves obtaining vibration data in vacuum and in ambient air and comparing the two.

FIG. 9 depicts another such method in block diagram form. The method 900 of FIG. 9 includes steps 101-104 as discussed previously and also includes the step 905 of stimulating the object in atmospheric pressure (e.g., ambient air) to obtain data representing both (a) said unwanted mechanical vibration within the object and (b) vibration due to acoustical coupling. This data is compared is step 906 to the mechanical vibrations obtained from steps 101-104 to assess whether and what kind of effect the acoustical coupling has on the unwanted mechanical vibrations identified in steps 101-104. Acoustical coupling can alter the mechanical vibrations identified in steps 101-104, and consequently the effect that acoustical coupling has on noise generated solely by mechanical vibration may indicate, e.g., the advisability of incorporating sound-absorbing materials within the object to isolate one or more components producing mechanical vibration from other areas that alter noise generated solely by the mechanical vibration of those components.

Methods Involving Use of Information Pertaining to Unwanted Vibration

The information derived from methods above and from use of a vacuum testing chamber as disclosed herein may be used in a number of ways. In one instance, the information may be used to identify the component within the object that is generating noise so that the component or object can be modified to eliminate or dampen the vibration. Components such as speaker, microphone, fan, etc. can be tested individually as described above to assess noise generation as a function of frequency and amplitude of vibration. An object incorporating multiple components may be tested as described above to determine noise generation as a function of frequency and amplitude of vibration. If desired, one or more of the components may be tested individually to assess its noise generation characteristics, and the object incorporating all components can also be tested to generate its noise-generation characteristics.

For instance, one can test different components individually, then together in a larger object to identify the vibration source. Using a laptop computer as an example, one can determine at which fan speeds and at which frequencies and amplitudes of external vibration unwanted noise is produced. Likewise, one can independently measure noise generated as a function of vibration frequencies and amplitudes for a microphone and for a speaker. The data generated for noise as a function of stimulus applied can then be used in removing or damping some of the sources of vibration in the object. For example, the mass of certain pieces may be increased or decreased to change the noise-generating characteristics of the pieces and object in which they are incorporated. Vibration dampening material such as foam or counter-weight may be positioned near the component to dampen or remove vibration. Additional and/or different component bracing within the object may be used.

Figure 10:
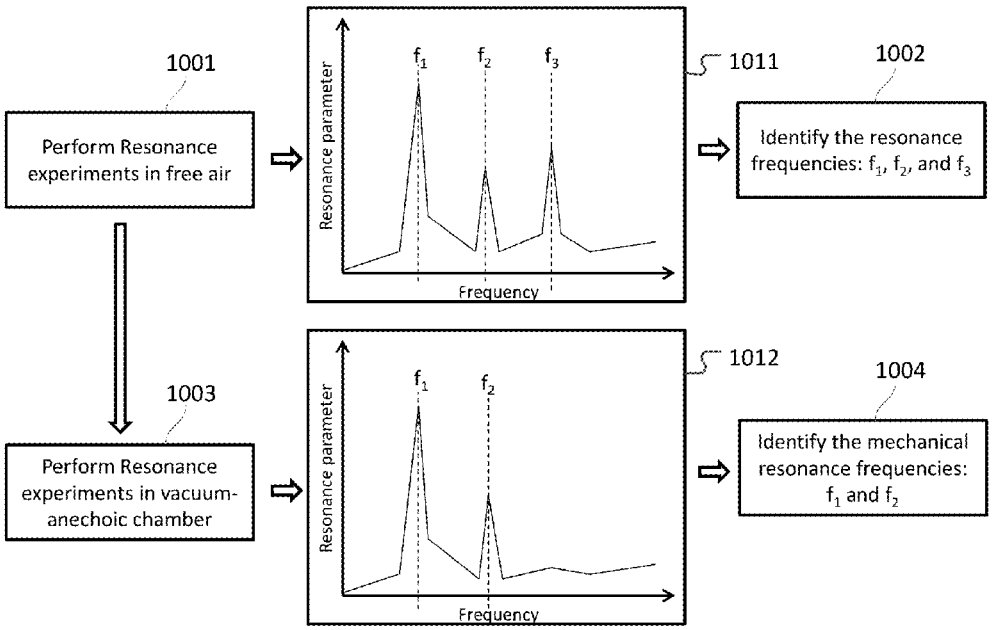
FIG. 10 is a high-level flowchart illustrating a method of identifying resonance having a source other than unwanted mechanical vibration and depicts how noise vibrations may differ when analyzing noise generated in air and in vacuum.

Another method as depicted in FIG. 10 involves identifying resonance due to non-mechanical noise. In step 1001, the object undergoes testing in free air at atmospheric pressure to identify resonant frequencies in step 1002. The upper chart 1011 in FIG. 10 depicts resonance at three different frequencies, $f_1$, $f_2$, and $f_3$. In step 1002, the object undergoes testing in a vacuum testing chamber to identify mechanical resonances in step 1003. The lower chart 1012 depicts resonance at two different frequencies $f_1$ and $f_2$. By comparing the results of the two test runs 1001, 1003, the resonance at frequency $f_3$ can be identified as a resonance generated by other than mechanical resonance (such as by air being compressed and pressure being released in a space within the object). This comparison aids in understanding the source of resonance so that a solution can be found to reduce or eliminate unwanted resonances that generates noise. The tests may both be performed in a vacuum testing chamber without and with air being evacuated from the chamber's space, respectively.

The information generated by analyzing an object such as a microphone, speaker, computer, cell-phone, headphone, headset, or any of the other objects discussed herein may be used to modify speaker output from the object. For instance, the object may have a noise compensator integrated into the object. The noise compensator produces a noise-compensation signal that modifies sound produced by the speaker to compensate for vibration within the object due to, e.g., the speaker playing a certain frequency and/or amplitude of music and/or due to, e.g., the object experiencing a certain frequency and/or amplitude of vibration, as measured by, e.g., an accelerometer in the object.

In one instance, a dedicated processor such as an ASIC for incorporation within an object can be configured to provide sound to the object's speaker that is essentially equal in magnitude but opposite in phase to the noise generated by the object so that the speaker cancels noise generated by the object. The ASIC may be connected to one or more of the following: an accelerometer (providing information on frequency, amplitude, and/or direction of acceleration), a sound card or sound processor, fan speed controller, and other component forming part of the object. The signals related to each of these components as part of the object would have been correlated previously with noise-generation data, and the ASIC will process the signals and compare with preprogrammed information of noise generation to derive the frequencies and amplitudes of sounds to generate in a speaker to cancel vibrations in the object from each of these components.

Active noise cancellation may be combined with any of the methods and equipment discussed above. Active noise cancellation involves detecting sound using and rapidly processing the sound to detect and cancel noise. Active noise cancellation typically utilizes a microphone to detect unwanted sound and circuitry to apply a signal to a speaker that generates noise-cancelling vibrations having about equal amplitude and frequency but a phase 180 degrees to that of the noise's amplitude, frequency, and phase. The signal for active noise cancellation can complement a noise-compensation signal as discussed above.

Any of the methods discussed above may additionally include a step of absorbing any sounds in the space within the vacuum testing chamber using a sound-absorbent as is described more fully below.

Vacuum Testing Chamber Details

As noted above, a vacuum testing chamber has a housing that encloses a space and a vacuum pump that evacuates fluid from the space to reduce the pressure within the space to a pressure below the ambient pressure outside of the housing. Preferably, the vacuum pump reduces pressure within the vacuum testing chamber to reduce or eliminate transmission of sound waves through the fluid so that fluid-transmitted sound detected by the vibration sensor is minimal or eliminated. The vacuum testing chamber can essentially eliminate reflected sound and identify primarily or essentially noise created by mechanical vibration within the object.

A vacuum pump may have a capacity to reduce the pressure in the space within the vacuum testing chamber to less than or equal to about 10 Torr for instance. The pressure may of course be lower, such as no more than about 7 Torr, or no more than about 1 Torr. In some instances, pressure is no more than about 0.5 Torr, 0.1 Torr, or 0.01 Torr. The vacuum pump may therefore create a pressure differential between the chamber's outer ambient and the space within the chamber equal to the difference between atmospheric pressure and any of the chamber pressures discussed above. The vacuum pump preferably maintains a constant pressure with little or no pressure fluctuation that would cause pressure pulsations within the chamber's space having a frequency in a range that could be detected by a sensor in contact with the object whose vibrations are being monitored. Suitable vacuum pumps include scroll, turbo-molecular, and rotary vane vacuum pumps.

The housing of a vacuum testing chamber may be stronger than a housing of a conventional acoustic anechoic chamber that is otherwise configured identically. A conventional acoustic anechoic chamber has essentially ambient pressure in the space within the chamber as well as outside the chamber, and consequently the walls of a conventional acoustic anechoic chamber have no pressure differential across them. The housing of a vacuum testing chamber needs to resist force caused by a pressure differential between the outside ambient and the vacuum induced into the chamber's space. Consequently, walls of a vacuum testing chamber are typically configured to withstand pressure forces that are much greater than walls of a conventional acoustic anechoic chamber could tolerate, where the conventional acoustic anechoic chamber is otherwise configured identically to the vacuum testing chamber. A vacuum testing chamber's walls may therefore be formed of thicker and/or stronger material and have more reinforcement and/or bracing than a corresponding conventional acoustic anechoic chamber's walls, since the housing of the vacuum testing chamber is configured to withstand additional substantial force created by the pressure differential. For instance, a conventional acoustic anechoic chamber's walls are formed of typical wall materials such as wood, metal, or masonry framing and wood and/or plaster-board walls. A vacuum testing chamber may have walls formed of metal reinforced with metal cross-bars, solid metal, or concrete, for instance, to withstand the force on its walls that a conventional acoustic anechoic chamber is not designed to withstand.

A vacuum testing chamber optionally has an acoustic absorbent such as an acoustic tile, acoustic panel, and/or acoustic coating on the surface of the housing's inner wall. A vacuum testing chamber may be configured as a full anechoic chamber, in which all walls (including ceiling and floor) have acoustic absorbent that typically has an irregular surface which helps to disrupt sound waves caused by vibration transmitted in the rarified atmosphere within the chamber. A vacuum testing chamber may be configured as a hemi-anechoic chamber, in which the floor has no acoustic absorbent. Acoustic absorbent as found in a conventional acoustic anechoic chamber may be used. Such acoustic absorbent is often formed of porous polymer or other material that has surface irregularities which help to disrupt sound waves. Absorbent tiles and/or panels may also be shaped and positioned to further disrupt sound waves in the rarefied atmosphere in the chamber's space by reflecting sound waves preferentially to other acoustic tiles or acoustic absorbent.

Other configurations are of course possible. A vacuum testing chamber may have walls without acoustic tiles or other acoustic absorbent if absolute pressure in the vacuum chamber is sufficiently low.

A vacuum testing chamber optionally has an access port such as a door or removable section that permits the object to be placed in and removed from the vacuum testing chamber. The access port will typically have a vacuum seal between the access port and its adjacent wall when the access port is closed in order to maintain vacuum in the space within the chamber. A vacuum seal may, for instance, be a ring seal compressed with sufficient pressure between the access port and housing wall to prevent air from leaking into the chamber's space from the ambient surrounding the outside of the vacuum testing chamber.

A vacuum testing chamber optionally has a support that holds the object at a distance between the floor and ceiling and away from other walls in the space within the chamber. A support may be, e.g., a table, a pedestal, or cables and/or platform that suspend the object within the space. A support may be stationary or may be movable. One example of a movable support is a vibratory support such as a shaker table as is found in an acoustic anechoic chamber. A support may have a vibration device attached to it, such as an electric motor with eccentric weight. A support may instead or additionally be hydraulically and/or electrically driven with, e.g., cylindrical or rack-and-pinion actuators and may have one, two, three, or six degrees of freedom, for instance. A support may have a securer such as a latch, lock, frame, bolt and bolt-hole arrangement, magnet, or other mechanism that holds the object to the support so that the object moves in tandem with the support as the support is moved.

A vibration sensor may be an integral part of the object whose vibration is being monitored. A vibration sensor may be a microphone and/or accelerometer that forms part of a phone, computer, or other electronic device. A vibration sensor may instead be a separate piece that can be attached to the object, such as a separate accelerometer, cantilever-piezoelectric vibration sensor, capacitor-type or inductor-type vibration sensor. A vibration sensor may transmit its signal wirelessly or over wire leads. One, two, three, or more vibration sensors may be employed to detect unwanted vibration.

The diaphragm in a microphone can form part of or can be a vibration sensor. A noise-generating section of a microphone (e.g. a screen or a portion of microphone housing that resonates) transmits vibration mechanically through components of the microphone and affects diaphragm movement, thereby changing the output signal from the microphone.

A vacuum testing chamber optionally has one or more ports (211 in FIG. 1) through which an electrical lead 212 from the vibration sensor passes. The port may have a vacuum seal 213 so that little or no air leaks from the environment outside the chamber and into the space within the chamber when the chamber is placed under vacuum. The seal may be, e.g., an epoxy resin, rubber, or other material that does not transmit air and that has sufficient mechanical strength to withstand the pressure differential created when the space within the chamber is under vacuum.

It is emphasized that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

What is claimed is:

1. A method of testing an audio device comprising a speaker and a microphone, said method comprising:

positioning the audio device inside of a vacuum chamber, said vacuum chamber comprising an insulated housing;

evacuating the vacuum chamber to a pressure of less than about 10 Torr;

stimulating the audio device in the evacuated vacuum chamber, said stimulating comprising activating with an input signal the speaker of the audio device and vibrating the audio device;

recording an output signal with the microphone of the audio device;

comparing, by a processor, the input signal to the output signal to determine a deviation between the input signal and the output signal caused by mechanical vibration of the audio device; and analyzing the deviation between the input signal and the output signal with the processor to identify a first set of resonance frequencies caused by mechanical vibration of the audio device.

2. The method of claim 1, further comprising:

stimulating the audio device under atmospheric pressure;

recording a second output signal with the microphone;

analyzing the second output signal to identify a second set of resonance frequencies caused by mechanical vibration of the audio device and said activating the speaker of the audio device; and comparing the first set of resonance frequencies with the second set of resonance frequencies to identify resonance frequencies caused by said activating the speaker of the audio device and not by mechanical vibration.

3. A method of analyzing vibration in an electronic device, comprising:

evacuating an amount of an elastic fluid from a space within a vacuum chamber, said vacuum chamber containing (a) the electronic device and (b) a vibration sensor that produces a signal in response to vibration of the electronic device, said amount being sufficient to reduce or suppress an acoustical coupling signal;

stimulating the electronic device to vibrate the electronic device;

detecting, using the vibration sensor, a first vibration signal;

comparing, with a processor, the first vibration signal with a second vibration signal to determine a deviation between the first vibration signal and the second vibration signal; and analyzing the deviation between the first vibration signal and the second vibration signal with the processor to identify a first set of resonance frequencies caused by mechanical vibration of the electronic device.

4. A method according to claim 3 wherein the act of stimulating the electronic device comprises applying an oscillating mechanical force to the electronic device with an actuator external to the electronic device to vibrate the object at different frequencies and/or amplitudes.

5. A method according to claim 4 wherein the electronic device comprises a microphone and said vibration sensor comprises a diaphragm of said microphone.

6. A method according to claim 3 wherein the act of stimulating the electronic device comprises applying varying voltage and/or current to a component of the electronic device to produce expected vibration and mechanical vibration.

7. A method according to claim 6 wherein the voltage and/or current are varied periodically.

8. A method according to claim 3 wherein the electronic device contains both a source of the mechanical vibration and the vibration sensor, said source comprising at least one of a speaker, a fan, or a hard-disk drive.

9. A method according to claim 3, further comprising absorbing sound waves with an acoustic absorbent.

10. A method according to claim 3 wherein the first set of resonance frequencies caused by mechanical vibration of the electronic device include one or more frequencies between about 15 Hz and about 25,000 Hz.

11. A method according to claim 3 wherein said electronic device is vibrated at a frequency between about 15 Hz and about 25,000 Hz.

12. A method according to claim 3, further comprising:

stimulating the electronic device in air to obtain data representing both (a) said first set of resonance frequencies caused by mechanical vibration of the electronic device and (b) a second set of resonance frequencies caused by vibration due to acoustical coupling, and identifying, based on the data, the first set of resonance frequencies at which said mechanical vibration occurs but said vibration due to acoustical coupling does not occur.

13. The method of claim 3, further comprising modifying a design of the electronic device to dampen vibration of the electronic device at a first frequency of the first set of resonance frequencies.

14. A method of analyzing vibration in an electronic device, the method comprising:

evacuating an amount of an elastic fluid from a space within a vacuum chamber, said vacuum chamber containing (a) an electronic device and (b) a vibration sensor that produces a signal in response to vibration of the electronic device, said amount being sufficient to reduce or suppress an acoustical coupling signal;

stimulating the electronic device to vibrate the electronic device, wherein the stimulating comprises at least one of (i) applying an oscillating mechanical force to the electronic device, or (ii) activating a speaker of the electronic device;

detecting, using the vibration sensor, a first vibration signal; and comparing, with a processor, the first vibration signal with a second vibration signal to determine a deviation between the first vibration signal and the second vibration signal.

15. A method according to claim 14 wherein the stimulating the electronic device comprises applying an external oscillating mechanical force to the electronic device to vibrate the electronic device at different frequencies and/or amplitudes.

16. A method according to claim 14 wherein the detecting the first vibration signal comprises detecting the first vibration signal using a microphone of the electronic device.

17. A method according to claim 14, further comprising absorbing sound waves with an acoustic absorbent provided in the space of the vacuum chamber.

18. A method according to claim 14 wherein the stimulating the electronic device comprises vibrating the electronic device at a frequency between about 15 Hz and about 25,000 Hz.

19. A method according to claim 14, further comprising analyzing the deviation between the first vibration signal and the second vibration signal with the processor to identify a first set of resonance frequencies caused by mechanical vibration of the electronic device.

20. A method according to claim 14, further comprising:

stimulating the electronic device under atmospheric pressure to obtain data representing both (a) a first set of resonance frequencies caused by mechanical vibration of the electronic device and (b) a second set of resonance frequencies caused by vibration due to acoustical coupling, and identifying, based on the data, the first set of resonance frequencies at which said mechanical vibration occurs but said vibration due to acoustical coupling does not occur.

21. A method according to claim 14, wherein:

the stimulating the electronic device comprises activating the speaker of the electronic device; and the detecting the first vibration signal comprises detecting the first vibration signal using a microphone of the electronic device.

* * * * *